US007770581B2

(12) United States Patent
Balke et al.

(10) Patent No.: US 7,770,581 B2
(45) Date of Patent: Aug. 10, 2010

(54) BREATHING MASK

(75) Inventors: Olaf Balke, Lübeck (DE); Manfred Gdulla, Lübeck (DE); Siegbert Tolk, Oldenburg (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 368 days.

(21) Appl. No.: 11/339,711

(22) Filed: Jan. 25, 2006

(65) Prior Publication Data

US 2006/0266363 A1 Nov. 30, 2006

(30) Foreign Application Priority Data

May 31, 2005 (DE) ..... 10 2005 024 729

(51) Int. Cl.
*A62B 18/08* (2006.01)

(52) U.S. Cl. ..... 128/206.15; 128/205.25; 128/205.27; 128/205.29; 128/207.12; 128/206.12; 128/206.21; 128/206.28

(58) Field of Classification Search ..... 128/205.25, 128/205.27, 205.29, 206.12, 206.15, 206.21, 128/206.28, 207.12
See application file for complete search history.

(56) References Cited

U.S. PATENT DOCUMENTS

| | | | | |
|---|---|---|---|---|
| 3,527,242 | A * | 9/1970 | Ansite | 137/102 |
| 4,793,342 | A * | 12/1988 | Haber et al. | 128/202.27 |
| 4,934,360 | A * | 6/1990 | Heilbron et al. | 128/205.16 |
| 5,411,021 | A * | 5/1995 | Gdulla et al. | 128/206.28 |
| 6,883,518 | B2 * | 4/2005 | Mittelstadt et al. | 128/206.15 |
| 7,004,168 | B2 * | 2/2006 | Mace et al. | 128/206.21 |
| 7,013,896 | B2 * | 3/2006 | Schmidt | 128/206.15 |
| 7,017,576 | B2 * | 3/2006 | Olsen et al. | 128/205.25 |
| 7,025,060 | B1 * | 4/2006 | Nicholson | 128/206.29 |
| 7,028,689 | B2 * | 4/2006 | Martin et al. | 128/205.24 |
| 7,036,507 | B2 * | 5/2006 | Jensen | 128/206.19 |
| 7,040,319 | B1 * | 5/2006 | Kelly et al. | 128/204.22 |

FOREIGN PATENT DOCUMENTS

| | | |
|---|---|---|
| DE | 42 20 780 | 9/1993 |

* cited by examiner

*Primary Examiner*—Patricia M Bianco
*Assistant Examiner*—Nihir Patel
(74) *Attorney, Agent, or Firm*—McGlew and Tuttle, P.C.

(57) ABSTRACT

A breathing mask shall has an inspiration valve (4) that can be replaced in a simple manner. The breathing valve (4) is designed for this purpose as a modular assembly unit that can be inserted into the breathing gas channel (3) from the outer side (10) of the mask.

18 Claims, 2 Drawing Sheets

BREATHING MASK

CROSS REFERENCE TO RELATED APPLICATIONS

This application claims the benefit of priority under 35 U.S.C. §119 of German Patent Application DE 10 2005 024 729.6 filed May 31, 2005, the entire contents of which are incorporated herein by reference.

FIELD OF THE INVENTION

The present invention pertains to a breathing mask with a breathing valve in a breathing gas channel.

BACKGROUND OF THE INVENTION

A breathing mask of this type is known from DE 42 20 780 C1 (and corresponding U.S. Pat. No. 5,411,021 which is hereby incorporated by reference). The breathing mask comprises a mask body between a mask interior space and the outer side of the mask and a connection housing, which is inserted into the mask body by means of a snap-in connection. The connection housing contains a breathing connection with an inspiration valve, an inner half mask, a speech diaphragm, and an expiration valve. The valves comprise a valve seat and a diaphragm, which is fastened in the area of the valve seat centrally at a web. The diaphragm has a pin-shaped component, which is inserted into a corresponding hole at the web.

It is specified for certain fields of use of breathing masks that the inspiration valves must be replaced at fixed time intervals. The connection housing must be removed from the mask body for this purpose in the prior-art breathing mask and the diaphragm must then be removed from the web reaching in from the side of the interior space of the mask. The replacement of the inspiration valve in the prior-art breathing mask is time-consuming and requires partial disassembly of the breathing mask. In addition, the inspiration valve is poorly accessible, and a tool is also frequently necessary for the replacement of the diaphragm. The inspiration valve becomes completely unfit for use if the valve seat is damaged and the entire connection housing must be replaced.

SUMMARY OF THE INVENTION

The object of the present invention is to improve a breathing mask of the type mentioned such that the breathing valve can be replaced in a simple manner.

According to the invention, a breathing mask is provided with a breathing valve in a breathing gas channel. The breathing valve is designed as a modular assembly unit that can be inserted into the breathing gas channel from the side of the mask.

The breathing valve may have a handle directed toward the outer side of the mask.

The breathing valve may be fastened in the breathing gas channel with a snap-in connection.

The breathing valve may advantageously comprise a valve seat and a diaphragm element fastened on one side.

The breathing valve may advantageously comprise an inspiration valve arranged in the breathing gas channel of a breathing connection.

The advantage of the present invention is essentially that the breathing valve is inserted into the breathing gas channel as a modular assembly unit from the outer side of the mask. It is not necessary to disassemble the breathing mask for this. The modular assembly unit contains the valve seat and the diaphragm element.

It is especially advantageous to arrange on the valve body of the breathing valve a handle, which is directed toward the outer side of the mask and by which the breathing valve can be grasped for insertion or for removal.

It is especially advantageous to fasten the breathing valve by means of a snap-in connection in the breathing gas channel. The breathing valve advantageously comprises the valve seat and a diaphragm element, which is fastened on one side and lies like a plate on the valve seat. Opening of the valve with a large cross section favorable for flow is improved by the one-sided clamping of the diaphragm element.

The breathing valve according to the present invention is arranged as an inspiration valve in the breathing gas channel of the breathing connection. The breathing connection is normally freely accessible, because a filter cartridge is attached from the outside or a flexible tube with fresh gas supply is connected.

Designing the expiration valve as a modular assembly unit that can be fastened by means of a snap-in connection is also within the scope of the present invention, so that both valves can be replaced without taking apart the breathing mask.

An exemplary embodiment of the present invention is shown in the figure and will be explained in greater detail below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
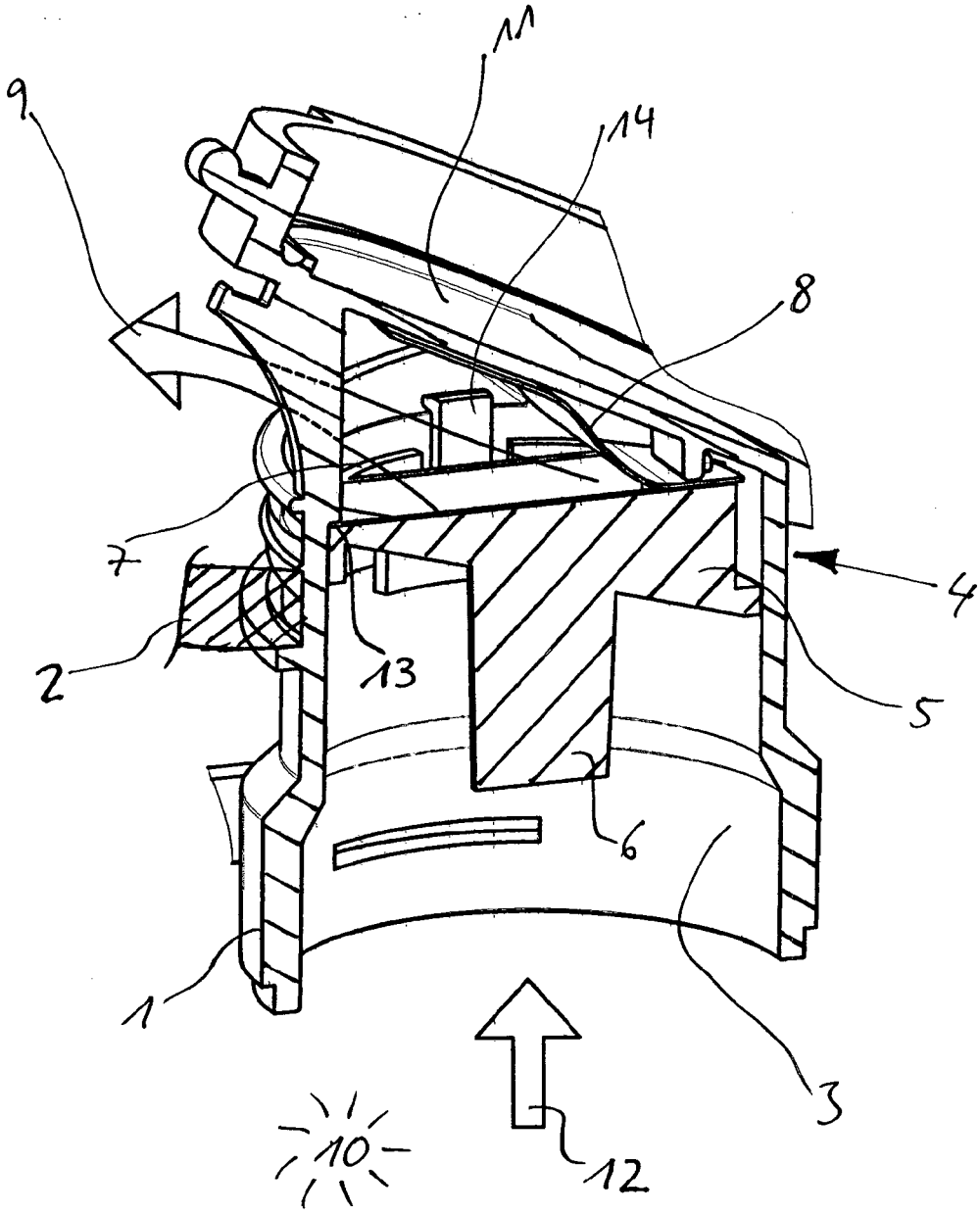
FIG. 1 is a cross sectional detail view of a breathing connection at a mask body of a breathing mask.
Figure 2:
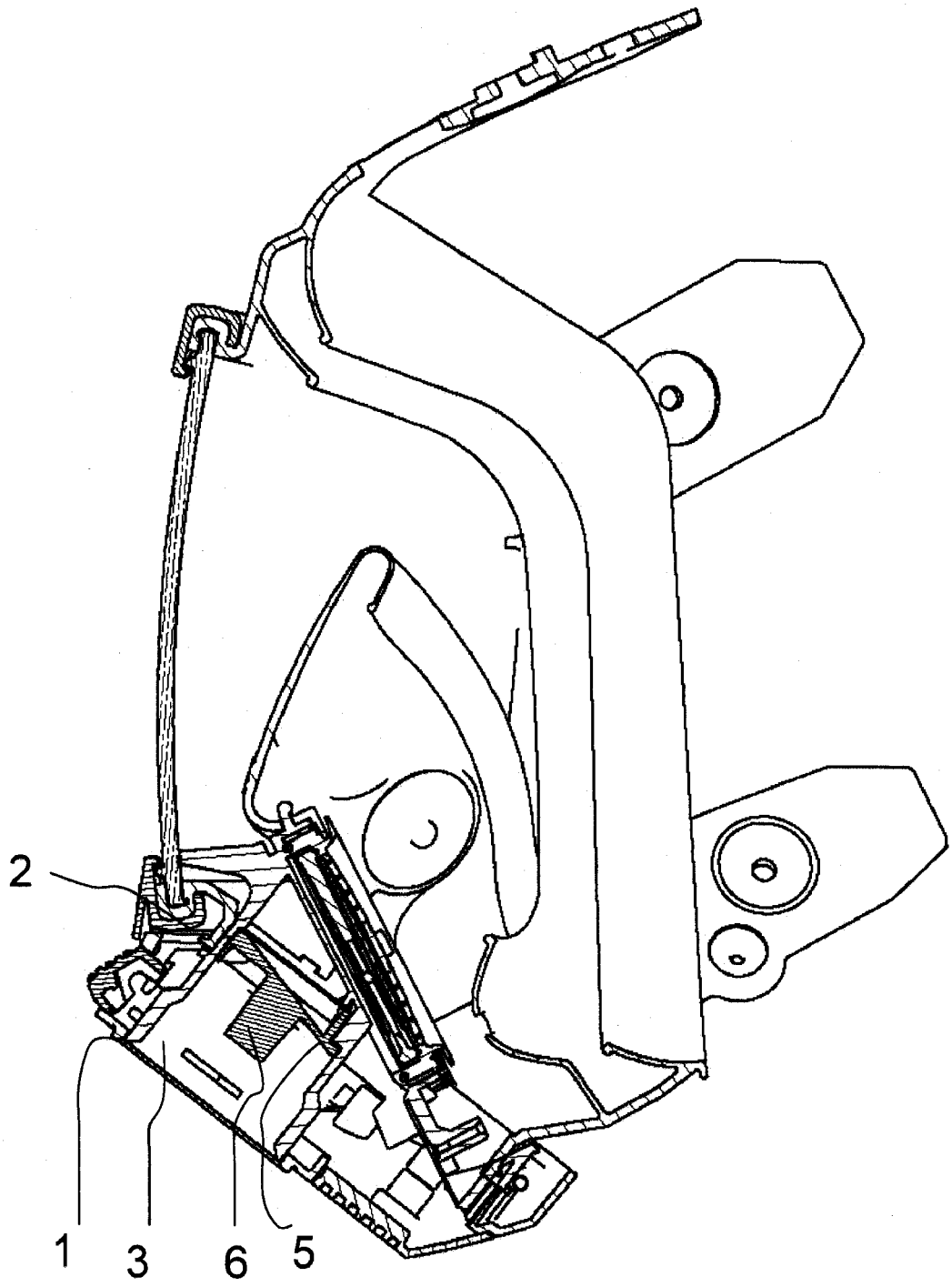
FIG. 2 is a cross section of a breathing mask with the breathing valve of the present invention.

Referring to the drawings in particular, the figures shows a detail of a breathing connection 1 at a mask body 2 of a breathing mask. The breathing mask 2 is not shown more specifically. The breathing connection 1 surrounds a breathing gas channel 3 and contains an inspiration valve 4. The inspiration valve 4 comprises a valve body 5 with a handle 6, a valve seat 7 and a diaphragm element 8, which is fastened on one side at the valve body 5 and lies on the valve seat 7. The breathing gas flows along arrow 9 from the outer side 10 of the mask over the inspiration valve 4 and into the interior space 11 of the mask, which interior space is not shown. The inspiration valve 4 opens with such flow and the diaphragm element 8 lifts off from the valve seat 7. The figure shows the opened inspiration valve 4.

The inspiration valve 4 is introduced into the breathing gas channel 3 from the outer side 10 of the mask along arrow 12. The inspiration valve 4 can be held by the handle 6 for this purpose and pushed against a stop 13 within the breathing gas channel 3, where it is fixed by means of a snap-in connection 14, not shown in greater detail, in the breathing gas channel 3. By pulling the handle 6 opposite the direction of arrow 12, the inspiration valve 4 can be removed from the breathing gas channel 3 and replaced with another one.

While a specific embodiment of the invention has been shown and described in detail to illustrate the application of the principles of the invention, it will be understood that the invention may be embodied otherwise without departing from such principles.

What is claimed is:

1. A breathing mask with a breathing valve in a breathing gas channel, the breathing valve being designed as a modular assembly unit completely inserted into the breathing gas channel from one side of the mask, the breathing valve comprising a valve body with a handle, a valve seat and a diaphragm element which is fastened on one side of the valve body, said handle being directed toward an outer side of the mask and by which the breathing valve can be grasped for removal, said breathing gas channel having an attachment on the outer side of the mask to one of a filter cartridge and a flexible gas supply tube, said breathing valve being arranged downstream of said attachment.

2. A breathing mask in accordance with claim 1, wherein the breathing valve is fastened in the breathing gas channel with a snap-in connection.

3. A breathing mask in accordance with claim 1, wherein the breathing valve is an inspiration valve arranged in the breathing gas channel of a breathing connection.

4. A breathing mask in accordance with claim 1, wherein said outer side is diametrically opposite a side of the mask facing the face of the user;

said mask defines said breathing gas channel between said outer side of said mask and said side of said mask facing the face of the user.

5. A breathing mask combination in accordance with claim 4, wherein:

an interior surface of said breathing gas channel is in direct contact with breathing gas flowing through said breathing gas channel from said outer side toward said inner side.

6. A breathing mask combination in accordance with claim 5, wherein:

said breathing mask body has an inner side directed towards a face of a user of the mask body, said outer side of the breathing mask body being diametrically opposite said inner side, said interior surface guiding said valve body from said outer side toward said inner side, said diaphragm element is lifted off said valve seat by breathing gas flowing through said breathing connection from said outer side toward said inner side of the mask, said valve seat being part of said valve body.

7. A breathing mask and breathing valve combination, comprising:

a breathing mask body;

a breathing connection at said mask body, said breathing connection surrounding a breathing gas channel and having an interior surface; and a breathing valve body with cooperating parts provided as a modular assembly unit that can be inserted into the breathing gas channel from one side of the mask body, said modular assembly unit being a separate structure from other components of the breathing mask, said breathing valve body having a handle arranged within space defined by said interior surface of said breathing connection and directly accessible through said breathing connection from said one side of said mask body.

8. A breathing mask combination in accordance with claim 7, wherein said one side is an outside of said mask body.

9. A breathing mask combination in accordance with claim 7, wherein the breathing valve body is fastened in the breathing gas channel with a snap-in connection.

10. A breathing mask combination in accordance with claim 7, wherein the breathing valve comprises a valve seat and a diaphragm element fastened on one side.

11. A breathing mask combination in accordance with claim 7, wherein the breathing valve body forms an inspiration valve arranged in the breathing gas channel of said breathing connection.

12. A breathing mask combination in accordance with claim 7, wherein:

said breathing mask body has an inner side directed towards a face of a user of the mask body, said breathing mask body having an outer side diametrically opposite said inner side, said breathing connection having an interior surface guiding said valve body from said outer side toward said inner side, said breathing valve body including a valve seat and a diaphragm element fastened on one side of said valve seat, said diaphragm element being lifted off said valve seat by breathing gas flowing through said breathing connection from said outer side toward said inner side of the mask, said interior surface of said breathing connection being in direct contact with breathing gas flowing through said breathing connection from said outer side toward said inner side.

13. A breathing mask and breathing valve combination, comprising:

a breathing mask body, said breathing mask body having an inner side directed towards a face of a user of the mask body, said breathing mask body having an outer side diametrically opposite said inner side;

a breathing connection at said mask body, said breathing connection surrounding a breathing gas channel and having an interior surface, said breathing mask body defining said breathing gas channel between said breathing connection and said inner side of said breathing mask body; and a breathing valve body with a valve seat and a diaphragm element fastened on one side of said valve seat, said valve seat and said diaphragm element being provided as a modular assembly unit that can be inserted into said breathing gas channel from said outer side of said mask body toward said inner side and is guided by said interior surface of said breathing connection, said interior surface of said breathing connection being in direct contact with breathing gas flowing through said valve body from said outer side toward said inner side, said breathing valve body having a handle arranged within space defined by said interior surface of said breathing connection and directly accessible through said breathing connection from said outer side of said mask body.

14. A breathing mask combination in accordance with claim 13, wherein said breathing valve body has a handle directed toward an outside of said mask body.

15. A breathing mask combination in accordance with claim 13, wherein said breathing valve body is fastened in said breathing connection with a snap-in connection.

16. A breathing mask combination in accordance with claim 13, wherein the breathing valve body forms an inspiration valve.

17. A breathing mask combination in accordance with claim 13, wherein:

said diaphragm element is lifted off said valve seat by breathing gas flowing through said breathing connection from said outer side toward said inner side of the mask.

18. A breathing mask combination in accordance with claim 13, wherein:

said modular assembly unit is a separate structure from other components of the breathing mask.

* * * * *